US007788870B1

(12) United States Patent
Spencer

(10) Patent No.: US 7,788,870 B1
(45) Date of Patent: Sep. 7, 2010

(54) METHOD AND ROOFING STRIP FOR RETARDING MOSS, FUNGI, AND ALGAE GROWTH ON ROOFS

(76) Inventor: David Spencer, 2501 Old Sherwood Ct., Walled Lake, MI (US) 48390

( * ) Notice: Subject to any disclaimer, the term of this patent is extended or adjusted under 35 U.S.C. 154(b) by 0 days.

(21) Appl. No.: 12/004,463

(22) Filed: Dec. 20, 2007

Related U.S. Application Data

(60) Provisional application No. 60/879,372, filed on Dec. 20, 2006.

(51) Int. Cl.
*E04D 1/00* (2006.01)

(52) U.S. Cl. ..... 52/518; 52/57; 52/101; 52/199; 52/276; 52/530; 52/515; 52/516

(58) Field of Classification Search ..... 52/518, 52/173, 101, 199, 276, 530, 57, 515, 516
See application file for complete search history.

(56) References Cited

U.S. PATENT DOCUMENTS

| | | | | | |
|---|---|---|---|---|---|
| 2,789,324 | A * | 4/1957 | Grossenbacher et al. | ..... | 52/78 |
| 3,479,130 | A * | 11/1969 | Rapaport | ..... | 424/413 |
| 3,484,267 | A * | 12/1969 | Sadler | ..... | 52/518 |
| 3,494,727 | A | 2/1970 | Rapaport | | |
| 3,598,627 | A | 8/1971 | Klimboff | | |
| 3,884,706 | A | 5/1975 | Little | | |
| 3,888,682 | A | 6/1975 | Nelson | | |
| 4,092,441 | A | 5/1978 | Meyer et al. | | |
| 4,189,889 | A * | 2/1980 | Yanoh | ..... | 52/530 |
| 4,276,732 | A | 7/1981 | Nielsen | | |
| 4,554,862 | A * | 11/1985 | Wolfert | ..... | 454/365 |
| 5,119,604 | A * | 6/1992 | Peterson et al. | ..... | 52/57 |
| 5,216,864 | A * | 6/1993 | Urgero | ..... | 52/515 |
| 5,356,664 | A | 10/1994 | Narayan et al. | | |
| 5,382,475 | A | 1/1995 | Kayser | | |
| 6,214,466 | B1 | 4/2001 | Joedicke | | |
| 6,571,520 | B2 * | 6/2003 | Koenig et al. | ..... | 52/287.1 |
| 6,585,813 | B2 | 7/2003 | Kiik et al. | | |
| 6,838,152 | B2 | 1/2005 | Joedicke | | |
| 7,354,596 | B1 * | 4/2008 | Banovetz et al. | ..... | 424/408 |
| 2003/0037698 | A1 * | 2/2003 | Kiik et al. | ..... | 106/15.05 |
| 2003/0150170 | A1 * | 8/2003 | Weber | ..... | 52/1 |
| 2003/0190431 | A1 * | 10/2003 | Jacobs | ..... | 427/397.8 |
| 2005/0166510 | A1 * | 8/2005 | Aschenbeck et al. | ..... | 52/518 |
| 2006/0204719 | A1 * | 9/2006 | Koschitzky | ..... | 428/143 |
| 2007/0044410 | A1 * | 3/2007 | Kalkanoglu | ..... | 52/526 |
| 2008/0115444 | A1 * | 5/2008 | Kalkanoglu et al. | ..... | 52/518 |
| 2008/0236079 | A1 * | 10/2008 | MacKinnon et al. | ..... | 52/311.1 |
| 2009/0151287 | A1 * | 6/2009 | Fink | ..... | 52/518 |
| 2009/0246728 | A1 * | 10/2009 | Hirsch et al. | ..... | 433/36 |

* cited by examiner

*Primary Examiner*—Richard E Chilcot, Jr.
*Assistant Examiner*—Mark R Wendell
(74) *Attorney, Agent, or Firm*—John R. Benefiel

(57) ABSTRACT

A method for inhibiting growths on shingled roofs, one or more of the strips installed along shingle courses. The strips are preferably formed of copper and have an upper portion formed with a pattern of through holes along the length of the strip and pattern of dimples extending along a lower portion of the length of the strips to increase the duration and extent of contact of rain or dew with the copper metal to increase the release of cupric ions effective in inhibiting growths on the roof.

4 Claims, 1 Drawing Sheet

METHOD AND ROOFING STRIP FOR RETARDING MOSS, FUNGI, AND ALGAE GROWTH ON ROOFS

CROSS REFERENCE TO RELATED APPLICATIONS

This application claims the benefit of U.S. provisional application No. 60/879,372 filed on Dec. 20, 2006.

BACKGROUND OF THE INVENTION

This invention concerns building roofs and more particularly pitched shingled roofs.

A moss and algae problem is often encountered in maintaining such roofs. In some exposures, there is a tendency for moss and/or algae and fungi to grow over time which discolors the shingles, particularly light colored shingles.

It has heretofore been recognized that adding retardant material to the shingles can be effective to some degree.

Zinc and copper strips have also been used, as the run off of rain water from these strips also contains cupric or zinc ions which are effective in retarding such growths.

However, these measures are often not sufficient to prevent such growths from occurring. The run off of rainwater occurs too quickly from copper strips to produce sufficient cupric ions, the active agent in inhibiting growth on the roof.

It is the object of the present invention to provide more effective inhibition of such growths on shingled roofs.

SUMMARY OF THE INVENTION

The above recited object as well as other objects of the present invention which will become apparent upon a reading of the following specification and claims are achieved by the use of an improved roofing strip of a growth inhibiting metal, preferably cooper, having an upper edge to be inserted under the shingles which strip is formed with a perforation pattern on an upper portion exposed of the strip with a dimple pattern formed on a lower portion of the strip.

The upper portion allows rainwater and dew generated moisture to penetrate through to the underside of the strip to expose both the outer and under surfaces of the copper to rainwater to maximize the release of cupric ions from the copper strip. The dimples temporarily capture the rainwater on the indentations to increase the release of cupric ions, while the dimple projections on the under sides create a tortuous flow path likewise increasing the duration of rainwater contact with the copper material. The effectiveness of the strips is in inhibiting growths on the shingles is thereby enhanced by the increased release of cupric ions, which is the effective agent in inhibiting roof growths.

DETAILED DESCRIPTION

Figure 1:
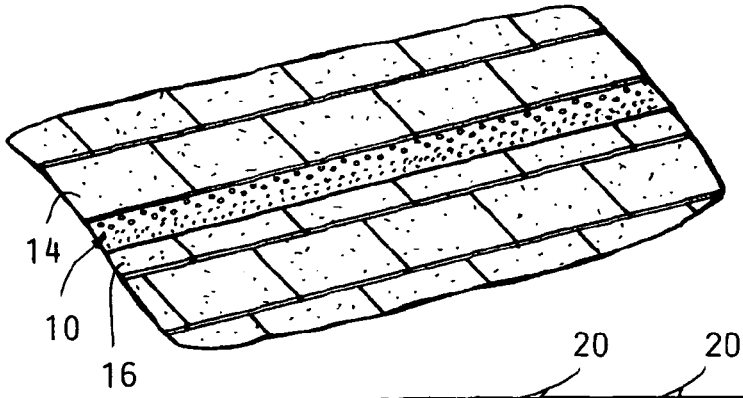
FIG. 1 is a pictorial view of a roof section having a copper strip according to the present invention installed along one course of shingles.
Figure 2:
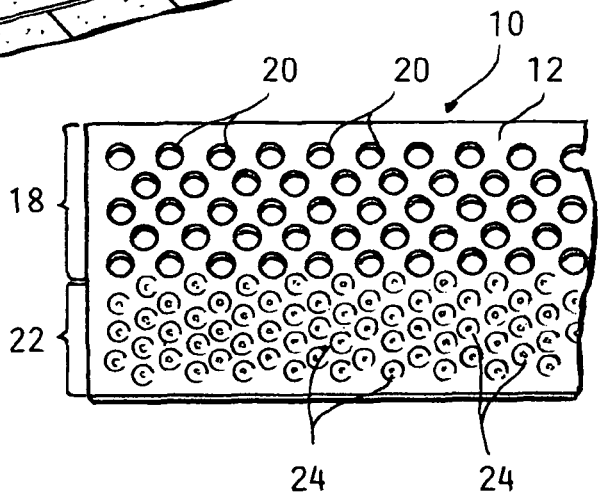
FIG. 2 is an enlarged view of one end of the strip shown in FIG. 1.
Figure 3:
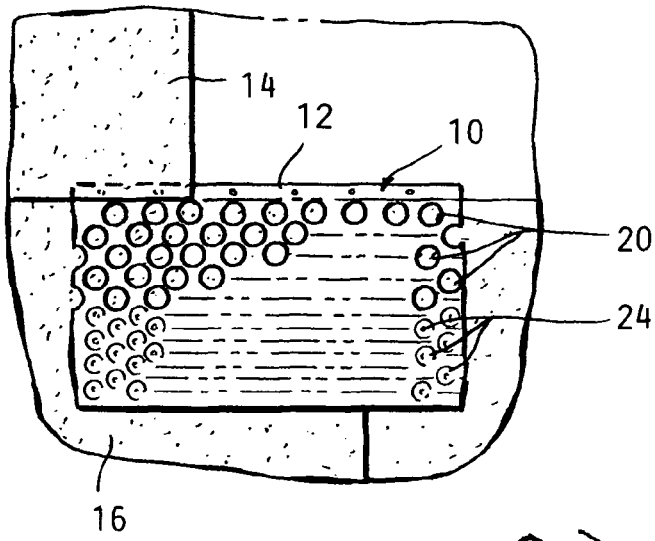
FIG. 3 is an enlarged view of a section of a strips shown installed in FIG. 1 with fragmentary portions adjacent shingle courses.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the present invention contemplates the use of strips 10 of copper sheet metal having an upper edge nailed to the roof deck beneath an overlapping edge of a shingle course 14 above the strip 10.

The copper strip 10 is preferably about 3-4 inches wide and sufficiently thick to remain flat against the roofing shingles in the next below course of shingles 16 even when subjected to high winds. The strip 10 can be in sections or in roll form.

Figure 4:
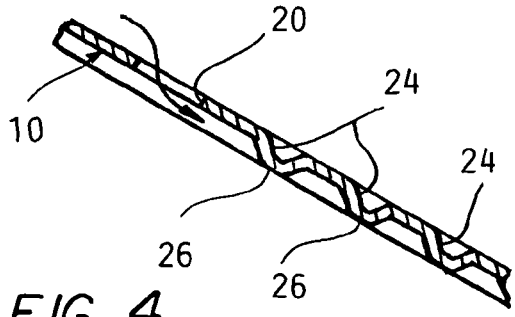
FIG. 4 is an enlarged sectional view of a section of the strip shown in FIG. 1.

According to the present invention, an upper portion 18 is perforated along the length with a pattern of through holes 20 allowing a portion of rain water and dew to penetrate through to the underside of the trip 10 as indicated in FIG. 4. A part of the rain water runs down the exposed surface to a lower portion 20, 22 which is formed with a pattern of dimples 24 along the length thereof forming depressions which intercept and collect some of the rainwater descending on the outer surface of the strip 10. The holes 20 are preferably offset from the dimples 24 such that rain or dew passing through the holes 20 will encounter the projecting bottoms 26 of the dimples 24.

The rainwater thus flows over both sides of the strip 10 and is held in contact longer on the upper surface by the presence of the dimples 24 and on the undersurface of the dimple bottoms 26.

The rainwater (or dew) flowing beneath the lower portion is forced to flow around the bottom 26 of the dimples so as to also be brought into contact with the copper for a longer period of time.

The slight elevation of the strips 10 caused also allows an increased flow of rainwater beneath the strip 10 to pick up cupric ions which are known to inhibit growths on a shingled roof.

More cupric ions are thus released by this strip configuration to substantially enhance the growth inhibiting effect of the strip 10.

As noted, copper is the preferred metal to be used as it has a more long lasting effect but other metals such as zinc may also be efficacious for this purpose.

Several courses of the strips 10 can be installed, spaced down every few courses of shingles as necessary to achieve growth inhibition for a particular exposure conditions.

The invention claimed is:

1. An article of manufacture for inhibiting roof growths comprising:

an elongated flat strip of a metal which will release growth inhibiting metal ions into water passing over said strip;

said flat strip having a pattern of dimples formed therein into a surface of one side of said strip, said dimples comprising shallow indentations, said pattern extending over a portion of said surface of said one side along the length thereof, said indentations forming depressions into one side of said strip able to capture and hold small volumes of water draining over said one side of said strip, and said indentation also forming projections on the other side of said strip;

a pattern of through holes also formed into said strip along the length thereof, and wherein said pattern of through holes is formed on portion and extending along the length of said strip separate from said portion formed with said pattern of dimples extending along the length thereof.

2. The article of manufacture according to claim 1 wherein said strip is formed of copper.

3. A method of inhibiting growths on a shingled roof comprising:

installing one or more flat strips along a course of shingles with an upper edge of said strip secured below a lower edge of a respective course of shingles and the remainder of said strip resting on a surface of an adjacent lower course of shingle, said one or more flat strips formed of a metal releasing growth inhibiting ions into water passing over said metal, said strip formed with a pattern of dimples on a lower portion of an exposed surface of said strip, said dimples indented into said exposed surface and forming depressions therein so as to capture temporarily rainwater or dew flowing down said roof and over said exposed surface of said one or more strips, said dimples also forming a pattern of projections on an underside of said one or more strips engaged with said surface of said next lower course of shingles; and, forming a pattern of through holes in said one or more strips extending along an upper portion of said strip so as to allow water to pass beneath said one or more strips and into contact with said projections formed by said dimples in the lower portion of said strips.

4. The method according to claim 3 wherein said one or more strips are formed of copper.

* * * * *